US011674364B2

(12) United States Patent
Al-Shuwaikhat

(10) Patent No.: US 11,674,364 B2
(45) Date of Patent: Jun. 13, 2023

(54) RESTORING WELL CASING—CASING ANNULUS INTEGRITY USING A CEMENT PORT IN A SLEEVED VALVE AND A CEMENT INJECTION AND PRESSURE TESTING TOOL

(71) Applicant: SAUDI ARABIAN OIL COMPANY, Dhahran (SA)

(72) Inventor: Hisham I. Al-Shuwaikhat, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 11 days.

(21) Appl. No.: 17/376,905

(22) Filed: Jul. 15, 2021

(65) Prior Publication Data

US 2023/0018350 A1 Jan. 19, 2023

(51) Int. Cl.
*E21B 33/14* (2006.01)
*E21B 34/06* (2006.01)

(52) U.S. Cl.
CPC ..... *E21B 33/14* (2013.01); *E21B 34/06* (2013.01); *E21B 2200/06* (2020.05)

(58) Field of Classification Search
CPC ..... E21B 33/14; E21B 34/06; E21B 2200/06; E21B 33/13; E21B 33/146
See application file for complete search history.

(56) References Cited

U.S. PATENT DOCUMENTS 2,526,695 A * 10/1950 Schlumberger ..... E21B 43/112 166/55.2
2,646,124 A * 7/1953 Strickler ..... E21B 33/14 166/290
5,024,273 A 6/1991 Coone et al.
5,038,862 A 8/1991 Giroux et al.
10,914,134 B1 2/2021 Harbi
2012/0325475 A1* 12/2012 Lee ..... E21B 34/063 166/285
2015/0267500 A1* 9/2015 Van Dongen ..... E21B 33/14 277/336

FOREIGN PATENT DOCUMENTS

CN 108252684 A 7/2018
GB 845130 A 8/1960
RU 2 367 773 C1 9/2009
WO 2013/172857 A1 11/2013

OTHER PUBLICATIONS

International Search Report and Written Opinion issued in corresponding International Patent Application No. PCT/US2022/037339, dated Sep. 16, 2022 (14 pages).

* cited by examiner

*Primary Examiner* — Brad Harcourt
(74) *Attorney, Agent, or Firm* — Osha Bergman Watanabe & Burton LLP

(57) ABSTRACT

A system includes a sleeved valve disposed within a casing string. The sleeved valve has a first cement port configured to open and close to an annulus and a first opening. The first opening and the first cement port are hydraulically connected within the sleeved valve. The system further includes a tool made of a tubular body having an outer diameter smaller than an inner diameter of the casing string. The tool includes a tool orifice and a cement injection needle in hydraulic communication with the tool orifice. The cement injection needle fits inside the first opening and, upon entering the first opening, a first hydraulic connection is created between the tool orifice and the first cement port.

18 Claims, 7 Drawing Sheets

RESTORING WELL CASING—CASING ANNULUS INTEGRITY USING A CEMENT PORT IN A SLEEVED VALVE AND A CEMENT INJECTION AND PRESSURE TESTING TOOL

BACKGROUND

In the petroleum industry, wells are built to access and produce hydrocarbons from formations located far beneath the Earth's surface. The structure of these wells are primarily made of multiple strings of casing and/or liner cemented in place. The casing/liner are subject to corrosion and erosion while deployed in subsurface conditions, and, during the process of cementing the casing/liner, cement may not be placed where it should be due to loss of cement to the formation or a man-made error.

Further, the cement may not bond properly or microchannels may be created within the cement. These unintended results cause pressure build up in the casing annulus and reduce the integrity of the well. When metal loss of casing/liner and low cement areas are discovered, the common practice is to perform perf and squeeze cement jobs to repair these areas. This practice requires holes to be made within the casing/liner in order to access the annulus behind the casing/liner. Furthermore, when cement is squeezed through these holes, microchannels may develop, further jeopardizing the integrity of the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a system and method for cementing an annulus of a casing string. The system includes a sleeved valve disposed within the casing string. The sleeved valve has a first cement port configured to open and close to the annulus and a first opening. The first opening and the first cement port are hydraulically connected within the sleeved valve. The system further includes a tool made of a tubular body having an outer diameter smaller than an inner diameter of the casing string. The tool includes a tool orifice and a cement injection needle in hydraulic communication with the tool orifice. The cement injection needle fits inside the first opening and, upon entering the first opening, a first hydraulic connection is created between the tool orifice and the first cement port.

The method includes installing a sleeved valve, having a first cement port and a first opening, within the casing string, running a tool, having a tool orifice and a cement injection needle, into the casing string, inserting the cement injection needle into the first opening, applying hydraulic pressure, through the cement injection needle and onto the first cement port, to open the first cement port to the annulus, and pumping cement from the tool into the sleeved valve and out into the annulus from the first cement port.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Throughout the application the reference to casing may refer to a string of casing defined as a large-diameter pipe that may be lowered into a well and connected to the surface of the Earth by a wellhead. The reference to casing may also be referring to a string of liner defined as a large-diameter pipe that may be lowered into a well and hung off of the bottom of a previous casing string, i.e., not connected to the surface of the Earth.

A loss of metal in a casing string and a lack of cement within the annulus of a casing string may cause the leakage of fluids from the well into the external environment. This may be detrimental to the health and safety of people and the environment. Therefore, when a loss of metal or lack of cement are discovered in a well, remediation is often required. Common forms of remediation are directed towards performing a remedial cement job such as a perf and squeeze cement job.

These jobs may remedy the lack of cement in the annulus of the casing, but these points are still considered weak points within the well, because they do not address the loss of metal in the casing or the remedial cement job itself creates holes in the casing that are not repaired. Thus, remediation methods that may be used to repair loss of metal in a casing string and/or lack of cement in the annulus of a casing string is beneficial. As such, embodiments herein are related to systems and methods for repairing loss of metal in a casing string by installing a sleeved valve within the casing string and cementing the annulus of a casing string using a tool and the sleeved valve.

Figure 1:
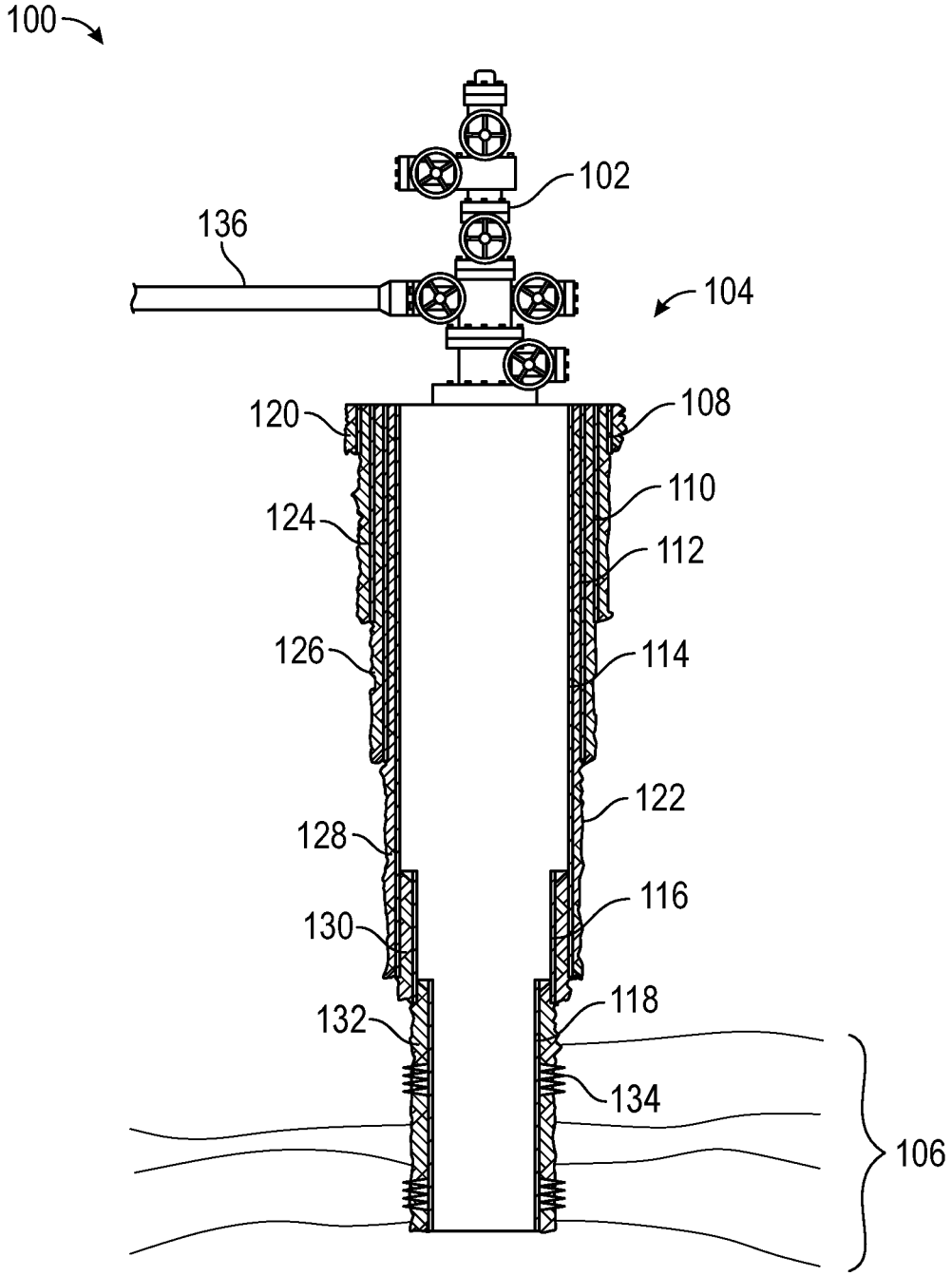
FIG. 1 shows an exemplary well in accordance with one or more embodiments.

FIG. 1 depicts an exemplary well (100) in accordance with one or more embodiments. The well (100) includes a wellhead (102) located on a surface (104) location that may be the Earth's surface. The wellhead (102) has a plurality of valves that control production of production fluids that come from a production zone (106) located beneath the surface (104). The valves also allow for access to the subsurface portion of the well (100) and the annuli located between various strings of casing. The wellhead (102) also provides a location for the surface (104)—reaching strings of casing to be hung off of.

The well (100) has six strings of casing: conductor casing (108), surface casing (110), intermediate casing (112), production casing (114), intermediate liner (116), and production liner (118). Each string of casing, starting with the conductor casing (108) and ending with the production liner (118), decreases in both outer diameter and inner diameter. Upon completion of the well (100), the inner surface of the production casing (114), intermediate liner (116), and production liner (118), and the space located within these strings of casing, make up the interior of the well (100). The interior of the well (100) may be accessed using various tools that may be run through the wellhead (102).

Each string of casing has an annulus that is located behind the casing string. The first annulus (120) is the space located between the outer diameter of the conductor casing (108) and the wellbore (122). The wellbore (122) is the exposed portion of the subsurface Earth. The first annulus (120) may be filled completely or partially with cement. The second annulus (124) includes both the space located between the outer diameter of the surface casing (110) and the inner diameter of the conductor casing (108) as well as the space between the outer diameter of the surface casing (110) and the wellbore (122). The second annulus (124) may be filled completely or partially with cement.

The third annulus (126) includes both the space located between the outer diameter of the intermediate casing (112) and the inner diameter of the surface casing (110) as well as the space between the outer diameter of the intermediate casing (112) and the wellbore (122). The third annulus (126) may be filled completely or partially with cement. The fourth annulus (128) includes both the space located between the outer diameter of the production casing (114) and the inner diameter of the intermediate casing (112) as well as the space between the outer diameter of the production casing (114) and the wellbore (122). The fourth annulus (128) may be filled completely or partially with cement.

The fifth annulus (130) includes both the space located between the outer diameter of the intermediate liner (116) and the inner diameter of the production casing (114) as well as the space between the outer diameter of the intermediate liner (116) and the wellbore (122). The fifth annulus (130) may be filled completely or partially with cement. The sixth annulus (132) includes both the space located between the outer diameter of the production liner (118) and the inner diameter of the intermediate liner (116) as well as the space between the outer diameter of the production liner (118) and the wellbore (122). The sixth annulus (132) may be filled completely or partially with cement.

The production liner (118) may be slotted liner or a screen such that fluid may flow into the production liner (118) from the formation. In this embodiment, there would be no cement in the sixth annulus (132). In other embodiments, the production liner (118) may be solid with cement in the sixth annulus (132) and perforations (134) may be made through the production liner (118), cement, and wellbore (122) in order to provide a pathway for production fluids to flow from the production zone (106) into the interior of the well (100). The formation fluids may travel from the interior of the well (100) to the surface (104) through production tubing (not pictured) and the wellhead (102). A pipeline (136) may be connected to the wellhead (102) to transport production fluids away from the well (100). The well (100) depicted in FIG. 1 is one example of a well (100) but is not meant to be limiting. The scope of this disclosure encompasses any well (100) design that has at least one string of casing in the well (100). Further, the well (100) may have any variation of surface equipment without departing from the scope of this disclosure.

Figure 2:
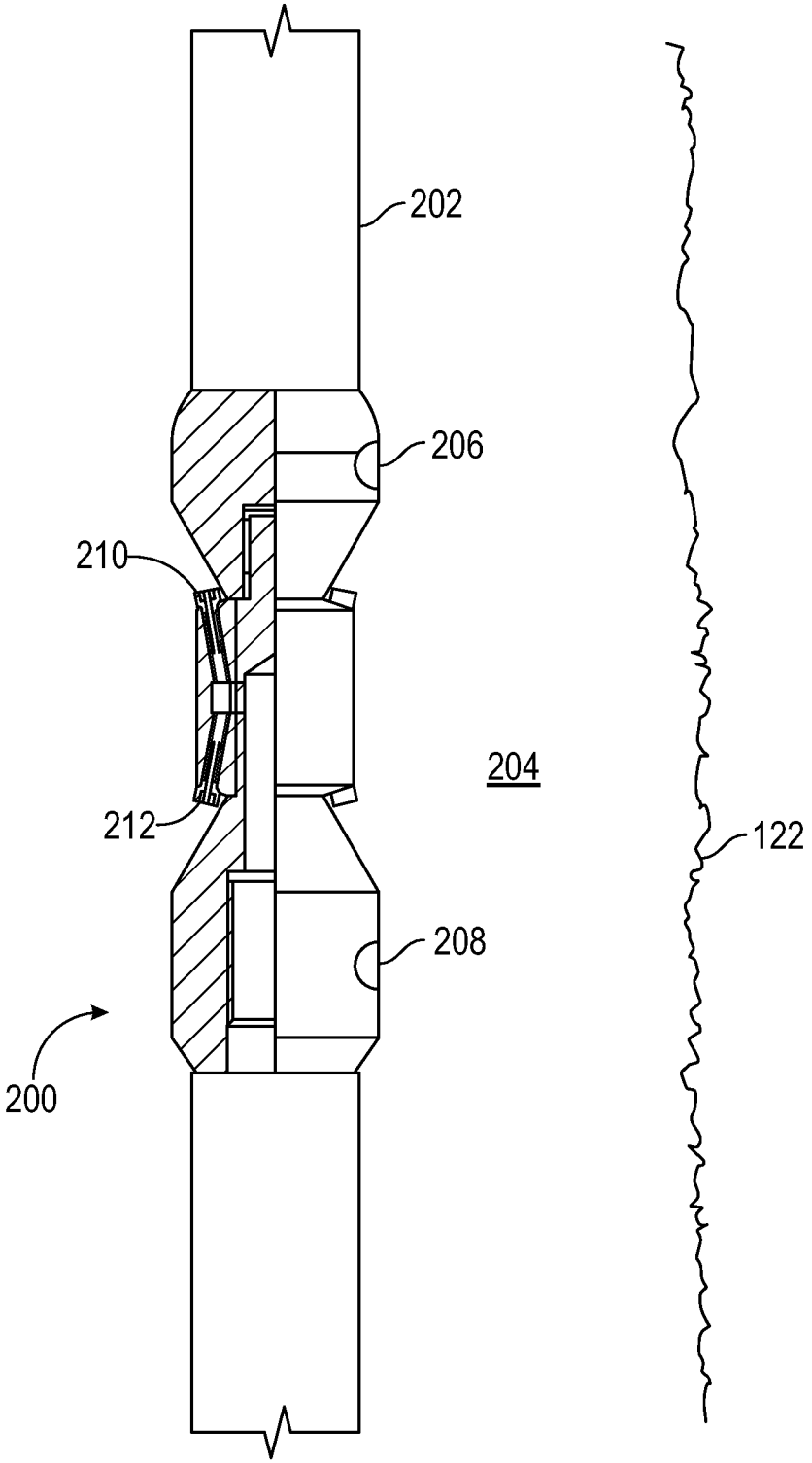
FIG. 2 shows a sleeved valve in accordance with one or more embodiments.

FIG. 2 depicts a sleeved valve (200) disposed within a string of casing (202) in accordance with one or more embodiments. The string of casing (202) may be any casing (202) such as the conductor casing (108), surface casing (110), intermediate casing (112), production casing (114), intermediate liner (116), and production liner (118) depicted in FIG. 1. There is an annulus (204) located between the casing (202) and the wellbore (122). The annulus (204) may be similar to the first annulus (120), second annulus (124), third annulus (126), fourth annulus (128), fifth annulus (130), or sixth annulus (132) described in FIG. 1. The annulus (204) may be devoid of cement or may be partially filled with cement.

The sleeved valve (200) may be installed within the casing (202) by being welded. In one or more embodiments, an interval of casing may be determined to have a loss of metal or lack of cement in the annulus (204). This portion of casing (202) is cut using a laser tool while the casing (202) is downhole. The sleeved valve (200) is welded into the space cut away within the casing (202) using a downhole welding tool. The sleeved valve (200) may be made of a similar metal to the casing (202), such as steel, or the sleeved valve (200) may be made of a different type of material that is able to withstand the temperatures and pressures seen downhole.

The sleeved valve (200) may have a tubular body with a first cement port (206), second cement port (208), first opening (210), and second opening (212). The first cement port (206) and the second cement port (208) are designed to stay closed until a pre-determined hydraulic pressure is seen across the first cement port (206) and the second cement port (208). When the sleeved valve (200) is installed in the casing (202), the first cement port (206) and the second cement port (208) face towards the annulus (204), such that, when open, the first cement port (206) and the second cement port (208) have access to the annulus (204). When the sleeved valve (200) is installed in the casing (202), the first opening (210) and the second opening (212) face towards the interior portion of the well (100) such that a tool run through the wellhead (102) may have access to the first opening (210) and the second opening (212).

The first opening (210) and the second opening (212) are designed to stay closed until a needle of a certain size enters the first opening (210) and the second opening (212). The first opening (210), the second opening (212), the first cement port (206), and the second cement port (208) are hydraulically connected within the sleeved valve (200). In other embodiments, there may be more than two cement ports (206, 208), more than two openings (210, 212), only one cement port (206, 208) and one opening (210, 212), one cement port (206, 208) and two openings (210, 212), or two cement ports (206, 208) and one opening (210, 212) without departing from the scope of the disclosure herein.

Figure 3:
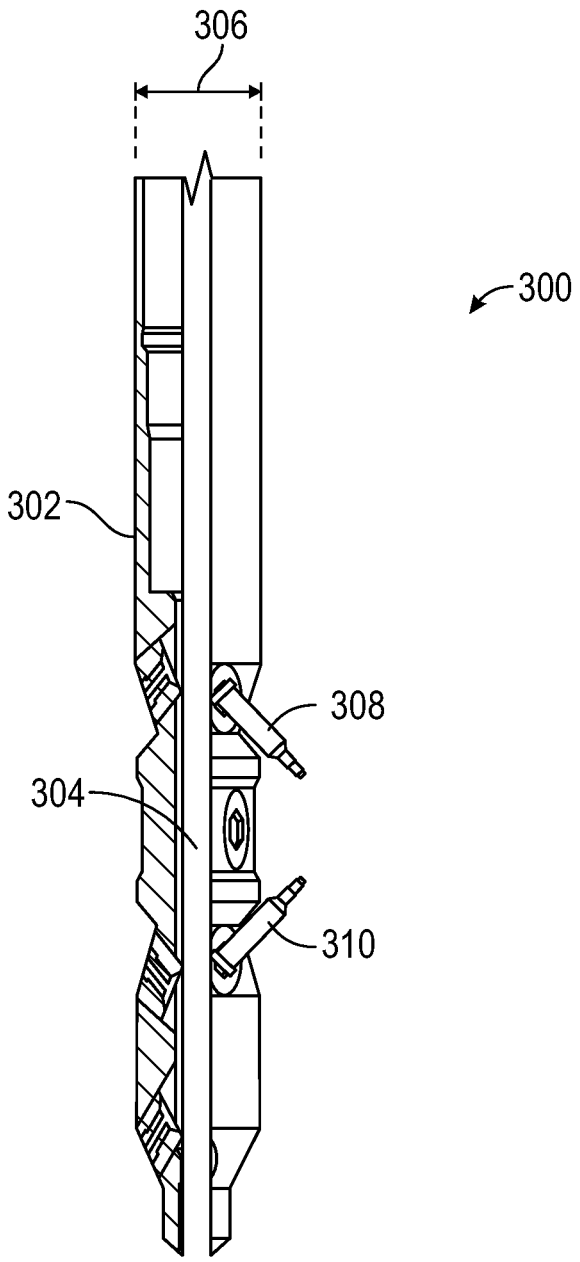
FIG. 3 shows a tool in accordance with one or more embodiments.

FIG. 3 depicts a tool (300) that may be used in conjunction with the sleeved valve (200) described in FIG. 2. The tool (300) has a tubular body (302) with a tool orifice (304), defining an empty space within the tubular body (302), that may be used to transport fluids such as cement. The tubular body (302) has an outer diameter (306). The tool (300) is designed to have an outer diameter (306) smaller than the inner diameter of any casing (202) that the tool (300) will be run through. The tool (300) may be made of any material that may withstand the temperatures, pressures, and fluids that may be seen downhole in a well (100), such as steel.

The tool (300) has the ability to be connected to another piece of equipment by any means know in the art, such as being threaded into another component. The tool (300) further includes a cement injection needle (308) and a pressure testing needle (310). The cement injection needle (308) and the pressure testing needle (310) are secured to the tubular body (302) and have the ability to jut in and out of the tubular body (302) by a command sent using electronic communication. The cement injection needle (308) has hydraulic access to the tool orifice (304). The cement injection needle (308) is designed to stay closed until the cement injection needle (308) enters an opening, such as the first opening (210) or the second opening (212) as described in FIG. 2.

The pressure testing needle (310) is in hydraulic communication with the tool orifice (304). The pressure testing needle (310) is connected, electronically, to the tubular body (302) such that measurements may be taken by the pressure testing needle (310) and the measurements may be electronically transferred from the pressure testing needle (310) to the tubular body (302) of the tool (300). More specifically, when the pressure testing needle (310) is inserted into the first opening (210), pressure in the pressure testing needle (310) is automatically released which cause signals to be sent to the pressure testing needle (310) to initiate pressure testing of the annulus (204). The signals may be electronic, hydraulic, or both.

Figure 4:
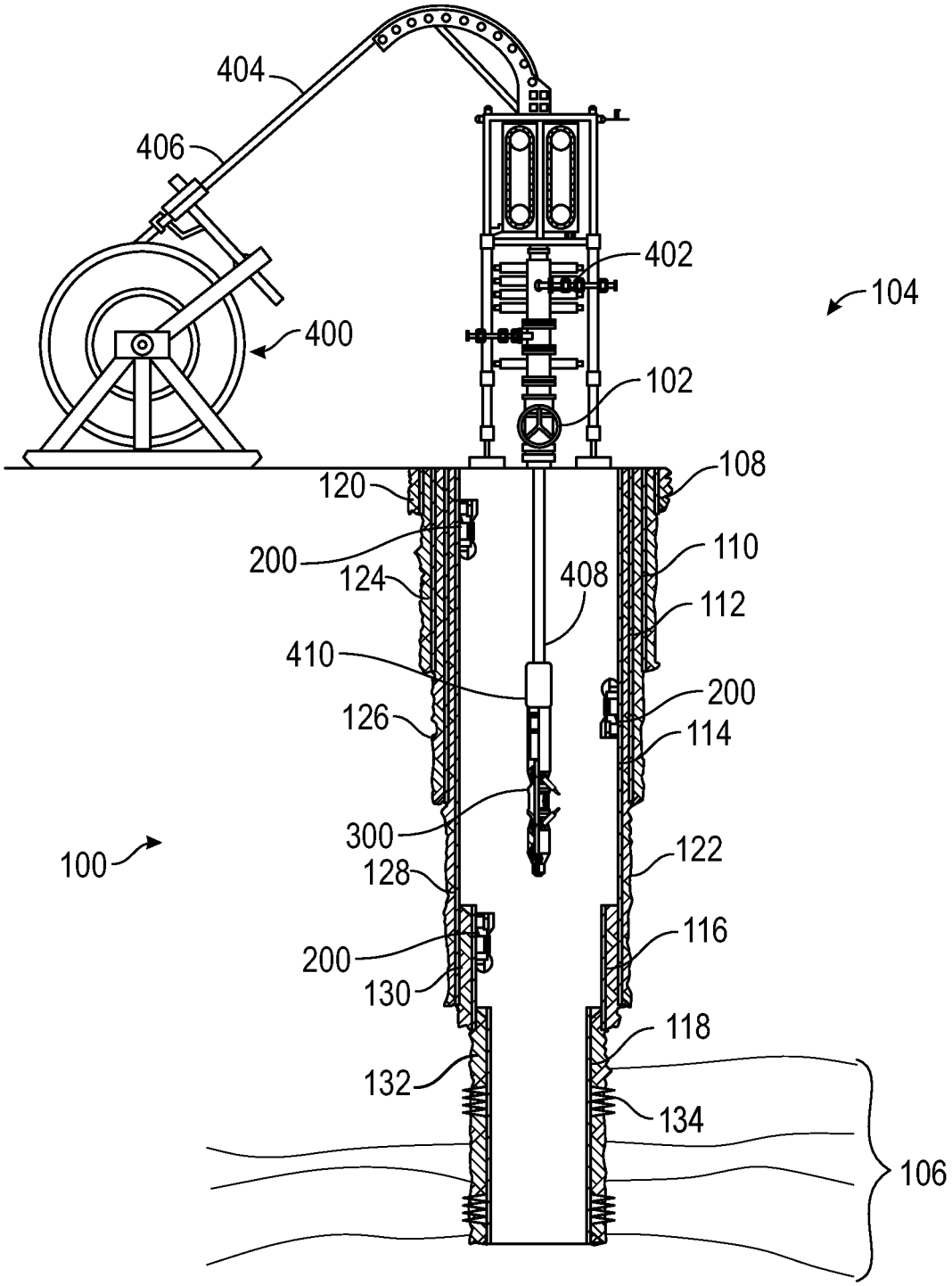
FIG. 4 shows a system in accordance with one or more embodiments.

FIG. 4 shows multiple sleeved valves (200) installed within various casing (202) strings within a well (100). FIG. 4 also shows the tool (300) deployed in the well (100) by a coiled tubing unit (400). Components shown in FIG. 4 that are similar to or the same as components shown in FIGS. 1-3 have not been redescribed for purposes of readability and have the same function as described above.

Specifically, FIG. 4 depicts a sleeved valve (200) installed at a shallower location of the production casing (114) to access the fourth annulus (128); a sleeved valve (200) installed at a deeper location of the production casing (114) to access the fourth annulus (128); and a sleeved valve (200) installed in the intermediate liner (116) to access the fifth annulus (130). The well (100) has a coiled tubing blow out preventer (BOP) (402) installed on top of the wellhead (102). A coiled tubing unit (400) is shown on the surface (104) with coiled tubing (404) being run though the BOP (402) and the wellhead (102) to access the interior of the well (100).

The coiled tubing (404) has a first end (406) and a second end (408). The first end (406) is at the surface (104) and the second end (408) is connected to a coiled tubing bottom hole assembly (BHA) (410) located downhole. The BHA (410) is connected to the tool (300) by any means known in the art, such as being threaded together. The connection between the BHA (410) and the tool (300) allows the second end (408) of the coiled tubing (404) to be connected to the tool (300). The coiled tubing unit (400) may deploy and retract the tool (300) into and out of the well (100) using the coiled tubing (404).

The coiled tubing (404), the BHA (410), the tool (300), and the pressure testing needle (310) are electronically connected. The coiled tubing unit (400) may have a computer processor that can transmit and receive information to and from the tool (300) and the pressure testing needle (310) through the coiled tubing (404) and the BHA (410). A command may be sent from the coiled tubing unit (400) to jut the cement injection needle (308) and pressure testing needle (310) out from the tool (300). The command may also allow the cement injection needle (308) and pressure testing needle (310) to be inserted into the first opening (210) and the second opening (212) of the sleeved valve (200). Further, the coiled tubing (404) may act as a means in which cement or another fluid may be pumped from the surface (104) to the tool orifice (304).

Figure 5A:
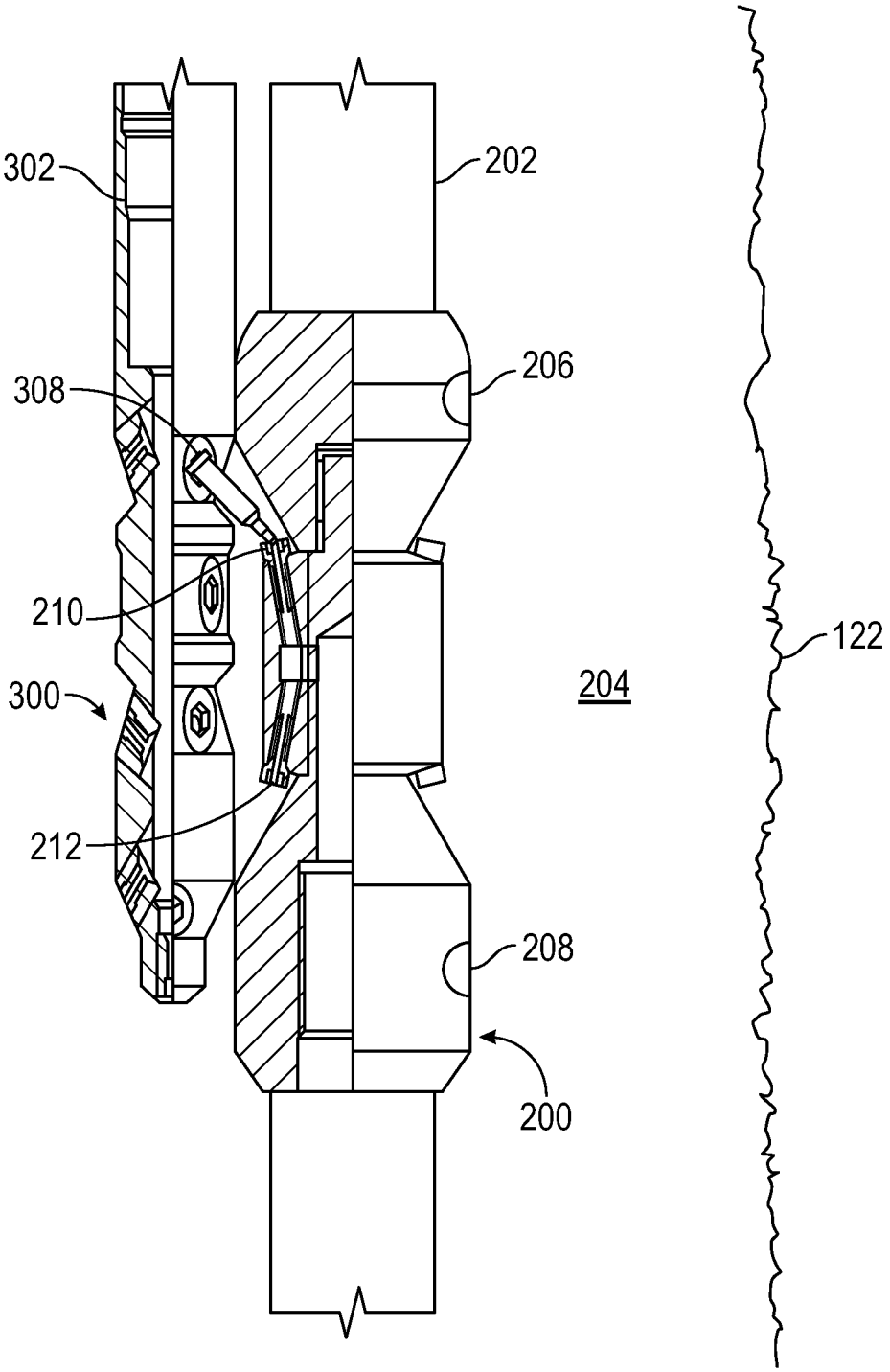
FIGS. 5A and 5B show the operation of the system in accordance with one or more embodiments.
Figure 5B:
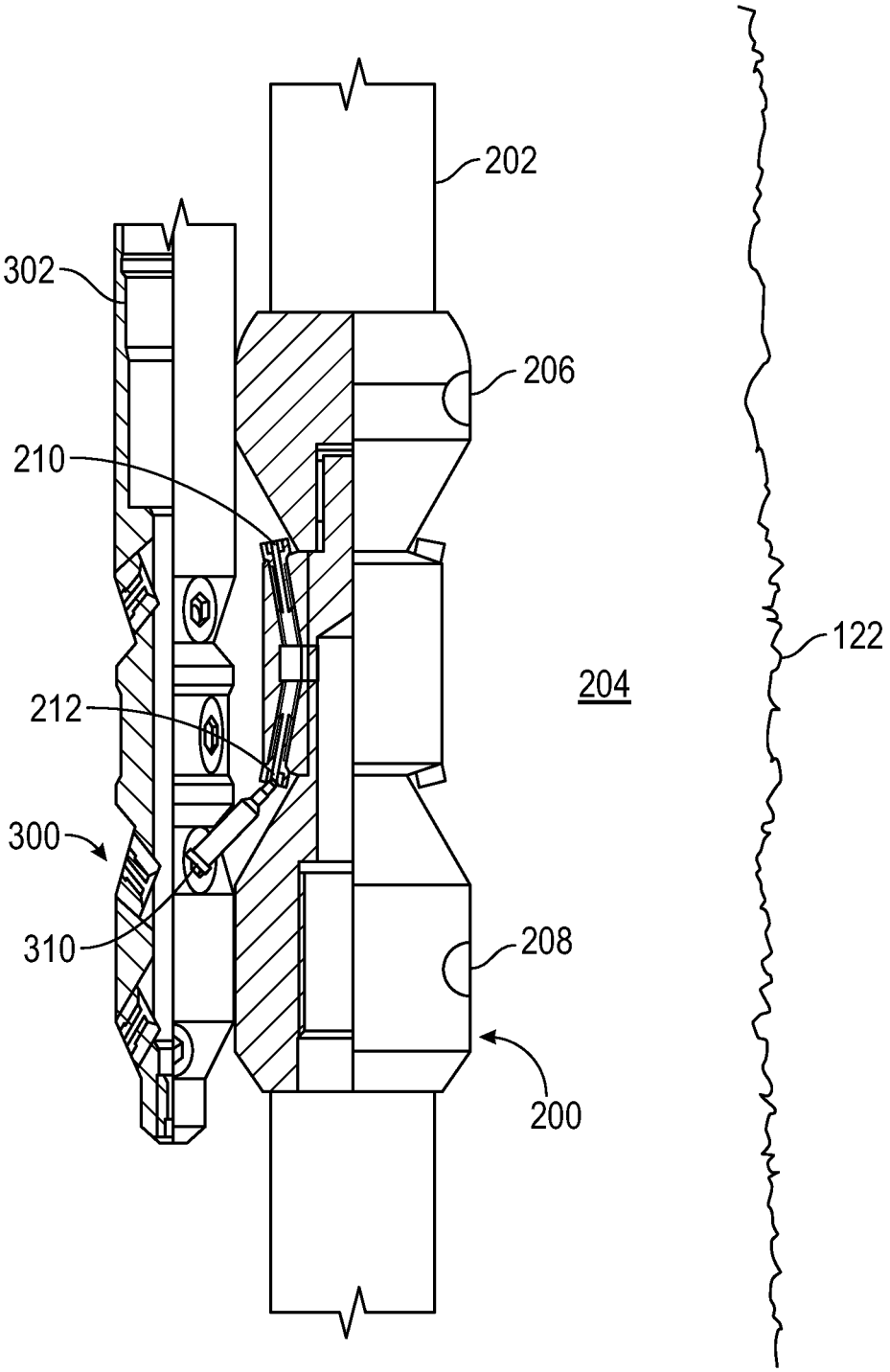

FIGS. 5*a* and 5*b* show how the tool (300) interacts with the sleeved valve (200). Specifically, FIG. 5*a* depicts the cement injection needle (308) inserted into the first opening (210) and FIG. 5*b* shows the pressure testing needle (310) inserted into the second opening (212). Components described in FIGS. 5*a* and 5*b* that are similar to or the same as components described in FIGS. 1-4 have not been redescribed for purposes of readability and have the same function as described above.

Turning to FIG. 5*a*, a command may be sent to the tool (300), using the coiled tubing unit (400) as described in FIG. 4, to jut out the cement injection needle (308) when the tool (300) is in close proximity to the sleeved valve (200). The cement injection needle (308) is designed to fit inside the corresponding first opening (210), thus the cement injection needle (308) may be inserted into the first opening (210).

As the cement injection needle (308) is inserted into the first opening (210), a first hydraulic connection is created between the tool orifice (304) and the first cement port (206). In further embodiments, if there is a presence of a second cement port (208) as shown in FIGS. 5*a* and 5*b*, a second hydraulic connection may be made between the tool orifice (304) and the second cement port (208). Cement may be pumped into the tool orifice (304) via the coiled tubing unit (400). The cement may exit the tool orifice (304) through the cement injection needle (308) when the cement injection needle (308) is inserted into the first opening (210).

As the cement is pumped into the sleeved valve (200), via the cement injection needle (308), a hydraulic pressure is built upon the first cement port (206) and the second cement port (208). When a predetermined hydraulic pressure is reached, the first cement port (206) and the second cement port (208) open to the annulus (204). Once the first cement port (206) and the second cement port (208) are opened, cement, or any other fluid, may be pumped from the surface (104) into the annulus (204) via the coiled tubing unit (400), the tool (300), and the sleeved valve (200).

Turning to FIG. 5*b*, a command may be sent to the tool (300), using the coiled tubing unit (400) as described in FIG. 4, to jut out the pressure testing needle (310) when the tool (300) is in close proximity to the sleeved valve (200). The pressure testing needle (310) is designed to fit inside the corresponding second opening (212), thus the pressure testing needle (310) may be inserted into the second opening (212).

As the pressure testing needle (310) is inserted into the second opening (212), the pressure testing needle (310) may be used to pressure test the annulus (204). This is done by pumping cement or fluid through the cement injection needle (308), inserted into the first opening (210), to open the first cement port (206) and the second cement port (208) thus providing access to the annulus (204). When the first cement port (206) and the second cement port (208) are open to the annulus (204) the pressure testing needle (310) is hydraulically connected to the annulus (204) and can measure the pressure in the annulus (204).

The pressure value(s) may be electronically transmitted from the pressure testing needle (310) to the BHA (410). The BHA (410) may then send the pressure value(s) to the surface (104). At the surface (104), the pressure value(s) may be viewed and recorded by a computer processor and monitor in the coiled tubing unit (400). The pressure value(s) may indicate when or if there is a sufficient amount of cement in the annulus (204).

Figure 6:
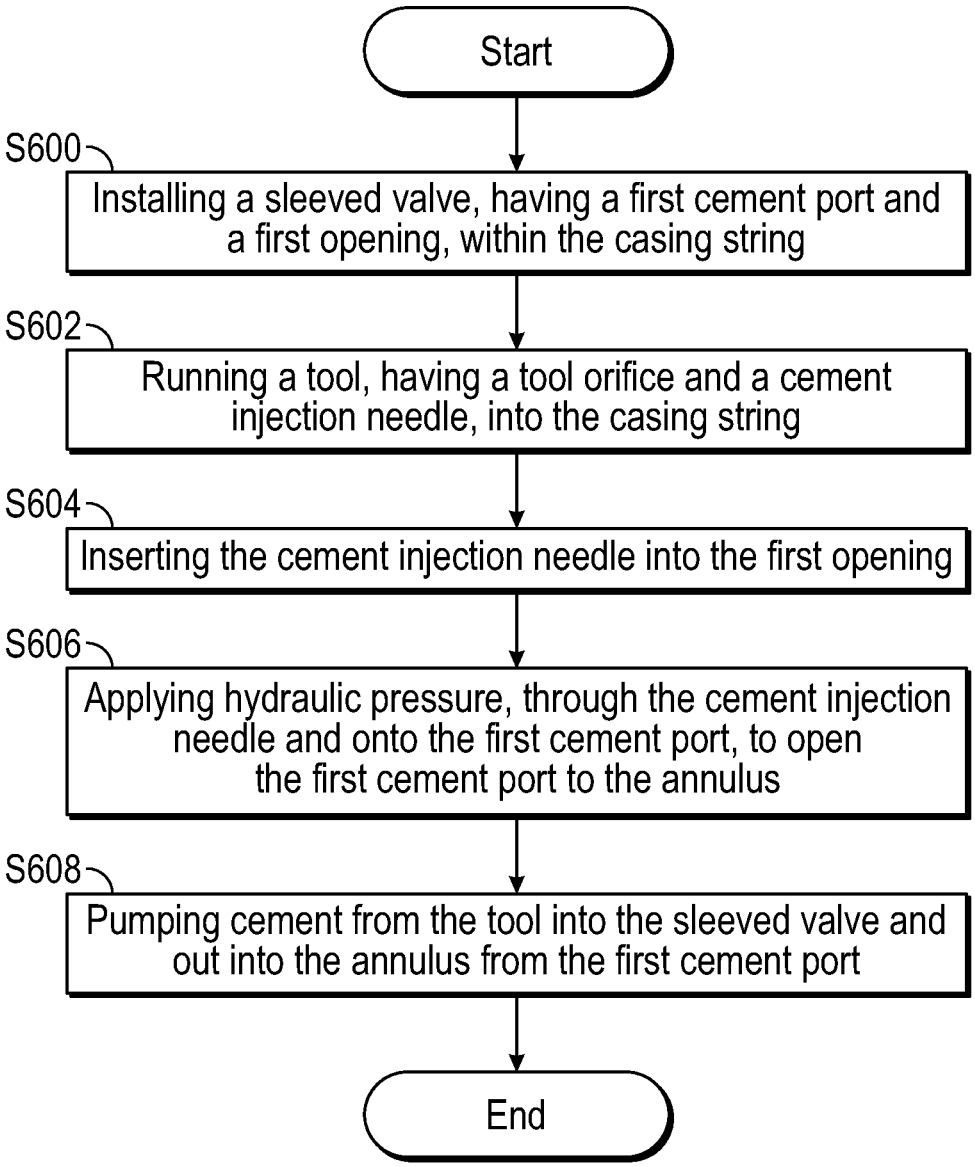
FIG. 6 shows a flowchart in accordance with one or more embodiments.

FIG. 6 depicts a flowchart in accordance with one or more embodiments. More specifically, FIG. 6 illustrates a method for cementing an annulus (204) of a casing (202) string. Further, one or more blocks in FIG. 6 may be performed by one or more components as described in FIGS. 1-5*b*. While the various blocks in FIG. 6 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a sleeved valve (200) having a first cement port (206) and a first opening (210) is installed within a casing (202) string (S600). In further embodiments, the sleeved valve (200) may also have a second cement port (208) and a first opening (210). The sleeved valve (200) may be installed at a location along the casing (202) string where a loss of metal or lack of cement has been identified. This portion of the casing (202) may cut away using a downhole laser tool. The sleeved valve (200) may then be installed in the open portion of the casing (202) using a downhole welding tool. The sleeved valve (200) is installed in the casing (202) with the first cement port (206) and the second cement port (208) facing the annulus (204) and the first opening (210) and the second opening (212) facing the interior of the well (100).

A tool (300), having a tool orifice (304) and a cement injection needle (308), is run into the casing (202) string (S602). In further embodiments, the tool (300) may also have a pressure testing needle (310), and the tool (300) may be run into the casing (202) using a coiled tubing unit (400) having coiled tubing (404) and a BHA (410). The BHA (410) is connected to the second end (408) of the coiled tubing (404), and the tool (300) may be installed on the BHA (410). The pressure testing needle (310), the tool (300), the BHA (410), and the coiled tubing (404) may be electronically connected. Further, a computer processor may be located on the surface (104) and the coiled tubing (404) may transmit information to the computer processor from the tool (300) and vice versa.

As the tool (300) approaches the sleeved valve (200), the cement injection needle (308) may be jut out of the tool (300) by a command sent from the surface (104). The cement injection needle (308) is inserted into the first opening (210) (S604). In further embodiments, the pressure testing needle (310) may also be jut out of the tool (300) and inserted into the second opening (212) of the sleeved valve (200). A hydraulic pressure is applied, through the cement injection needle (308) and onto the first cement port (206), to open the first cement port (206) to the annulus (204) (S606). The hydraulic pressure may also be applied to the second cement port (208), using the cement injection needle (308) in the first opening (210), to open the second cement port (208) to the annulus (204).

Cement is pumped from the tool (300) into the sleeved valve (200) and out into the annulus (204) from the first cement port (206) (S608). Cement may also be pumped from the tool (300) into the sleeved valve (200) and out into the annulus (204) from the second cement port (208). Cement may be pumped into the tool (300) and out into the annulus (204) using the coiled tubing unit (400). In further embodiments, the pressure testing needle (310) may be inserted into the second opening (212) while the cement injection needle (308) is in the first opening (210), and a pressure reading from the annulus (204) may be read using the pressure testing needle (310). The pressure reading may be transmitted from the cement injection needle (308) to the BHA (410) of the coiled tubing unit (400). The pressure reading may be transmitted from the BHA (410) to the surface (104) location using the coiled tubing (404). The pressure reading may be used to determine if or when there is a sufficient amount of cement in the annulus (204). This information may be used to indicate when to stop pumping cement into the annulus (204) using the cement injection needle (308).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for cementing an annulus of a casing string, the system comprising:

a sleeved valve disposed within the casing string, the sleeved valve comprising:

a first cement port configured to open and close to the annulus;

a first opening wherein the first opening and the first cement port are hydraulically connected within the sleeved valve; and a tool made of a tubular body having an outer diameter smaller than an inner diameter of the casing string, the tool comprising:

a tool orifice;

a pressure testing needle; and a cement injection needle in hydraulic communication with the tool orifice, wherein the cement injection needle fits inside the first opening and, upon entering the first opening, a first hydraulic connection is created between the tool orifice and the first cement port.

2. The system of claim 1, wherein the sleeved valve further comprises a second cement port configured to open and close to the annulus.

3. The system of claim 2, wherein the first opening and the second cement port are hydraulically connected within the sleeved valve.

4. The system of claim 3, wherein a second hydraulic connection is created between the tool orifice and the second cement port when the cement injection needle enters the first opening.

5. The system of claim 4, wherein the sleeved valve further comprises a second opening wherein the second opening, the first cement port, and the second cement port are hydraulically connected within the sleeved valve.

6. The system of claim 5, further comprising:

a coiled tubing unit comprising:

coiled tubing having a first end and a second end, wherein the first end is at a surface location, and a bottom hole assembly connecting the second end of the coiled tubing to the tool.

7. The system of claim 6, wherein the pressure testing needle fits inside the second opening and, upon entering the second opening, the pressure testing needle is hydraulically connected to the annulus through the first cement port and the second cement port.

8. The system of claim 7, wherein the coiled tubing, the bottom hole assembly, the tool, and the pressure testing needle are electronically connected.

9. The system of claim 8, wherein the pressure testing needle is configured to measure pressures in the annulus and transmit the pressures to the bottom hole assembly.

10. A method for cementing an annulus of a casing string, the method comprising:

installing a sleeved valve, having a first cement port and a first opening, within the casing string;

running a tool, having a tool orifice, a pressure testing needle, and a cement injection needle, into the casing string;

inserting the cement injection needle into the first opening;

applying hydraulic pressure, through the cement injection needle and onto the first cement port, to open the first cement port to the annulus; and pumping cement from the tool into the sleeved valve and out into the annulus from the first cement port.

11. The method of claim 10, wherein the sleeved valve comprises a second cement port.

12. The method of claim 11, further comprising:

applying hydraulic pressure, through the cement injection needle and onto the second cement port, to open the second cement port to the annulus.

13. The method of claim 12, further comprising:

pumping cement from the tool into the sleeved valve and out into the annulus from the second cement port.

14. The method of claim 13, wherein the sleeved valve further comprises a second opening.

15. The method of claim 14, further comprising:

inserting the pressure testing needle into the second opening.

16. The method of claim 15, further comprising:

measuring a pressure reading, using the cement injection needle, from the annulus.

17. The method of claim 16, further comprising:

transmitting the pressure reading from the cement injection needle to a bottom hole assembly of a coiled tubing unit.

18. The method of claim 17, further comprising:

transmitting the pressure reading from the bottom hole assembly to a surface location using coiled tubing.

* * * * *